US012654903B2

(12) United States Patent
Green

(10) Patent No.: US 12,654,903 B2
(45) **Date of Patent: *Jun. 16, 2026**

(54) STRUCTURALLY HARDENED PALLET ASSEMBLY AND COMPONENTS

(71) Applicant: Green Eagle USA, LLC, Georgetown, SC (US)

(72) Inventor: Guerry E Green, Georgetown, SC (US)

(73) Assignee: Green Eagle USA, LLC, Georgetown, SC (US)

( * ) Notice: Subject to any disclaimer, the term of this patent is extended or adjusted under 35 U.S.C. 154(b) by 180 days.

This patent is subject to a terminal disclaimer.

(21) Appl. No.: 18/523,776

(22) Filed: Nov. 29, 2023

(65) Prior Publication Data

US 2024/0367852 A1 Nov. 7, 2024

Related U.S. Application Data

(63) Continuation-in-part of application No. 18/451,636, filed on Aug. 17, 2023, now Pat. No. 12,168,546, which is a continuation of application No. 18/143,185, filed on May 4, 2023, now Pat. No. 11,807,417.

(51) Int. Cl.
*B65D 19/00* (2006.01)

(52) U.S. Cl.
CPC ..... *B65D 19/0095* (2013.01); *B65D 2519/00273* (2013.01); *B65D 2519/00293* (2013.01); *B65D 2519/00323* (2013.01); *B65D 2519/00333* (2013.01); *B65D 2519/00442* (2013.01); *B65D 2519/00572* (2013.01)

(58) Field of Classification Search
CPC ..... B65D 19/0095; B65D 19/20; B65D 2519/00333; B65D 2519/00547
USPC ..... 108/56.1, 51.11, 51.3
See application file for complete search history.

(56) References Cited

U.S. PATENT DOCUMENTS 3,469,542 A 9/1969 Ahlenius
3,572,261 A 3/1971 Vasiliou
4,077,334 A 3/1978 Svirklys
(Continued)

FOREIGN PATENT DOCUMENTS

GB 2270298 A 3/1994

*Primary Examiner* — Jose V Chen
(74) *Attorney, Agent, or Firm* — Bryan L. Baysinger; Thomas R. Parker, II; Maynard Nexsen PC

(57) ABSTRACT

Aspects of a pallet assembly are disclosed including two engagement stringers having a plurality of perpendicular stringers therebetween and engaged, end to end, to each engagement stringer, and one or more inert support surfaces supported thereby. The one or more support surfaces are a plurality of top slats supported and held directly by the frame comprising the stringers and the engagement stringers. The top slats include a structure that is complementary to a feature defined by the frame and that allows the top slats to mate with and be held by the frame. The pallet assembly demands fasteners for assembling the frame; however, in at least one aspect, the pallet assembly of the present disclosure also demands fasteners for attaching the top slats to the frame. In another aspect, the stringers and the engagement stringers each comprise a multilayer composite strip or multiple multilayer composite strips.

20 Claims, 8 Drawing Sheets

(56) References Cited

U.S. PATENT DOCUMENTS

| | | | | |
|---|---|---|---|---|
| 4,103,857 | A | 8/1978 | Levenhagen | |
| 4,112,854 | A | 9/1978 | Pitchford | |
| 4,841,880 | A | 6/1989 | Ferguson | |
| 5,417,167 | A | 5/1995 | Sadr | |
| 5,617,689 | A | 4/1997 | Beane | |
| 5,769,001 | A | 6/1998 | Viessmann | |
| 6,155,181 | A | 12/2000 | Chilcutt | |
| 6,192,807 | B1 | 2/2001 | Mason | |
| 7,637,219 | B2 | 12/2009 | Hartel et al. | |
| 9,016,212 | B2 | 4/2015 | Valiulis | |
| 9,546,019 | B2 | 1/2017 | Federl et al. | |
| 9,718,579 | B2 | 8/2017 | Pisano | |
| 11,807,417 | B1 * | 11/2023 | Green | B65D 19/0095 |
| 12,168,546 | B2 * | 12/2024 | Green | B65D 19/0095 |
| 2005/0247240 | A1 | 11/2005 | Nelson | |
| 2007/0245932 | A1 | 10/2007 | Nielsen | |
| 2008/0066657 | A1 | 3/2008 | Kuo | |
| 2008/0087203 | A1 | 4/2008 | Hartel et al. | |
| 2009/0211497 | A1 | 8/2009 | Koenes | |
| 2010/0175595 | A1 | 7/2010 | Grietems | |
| 2012/0298015 | A1 | 11/2012 | Jian | |
| 2013/0047897 | A1 | 2/2013 | Love | |
| 2013/0061784 | A1 | 3/2013 | Kessler | |
| 2014/0345501 | A1 * | 11/2014 | Lundius | B65D 19/40 108/51.11 |
| 2016/0068302 | A1 | 3/2016 | Clark et al. | |
| 2017/0225826 | A1 | 8/2017 | Xie | |
| 2019/0092522 | A1 | 3/2019 | Robinson | |
| 2019/0177036 | A1 | 6/2019 | Dominguez Guevara | |

* cited by examiner

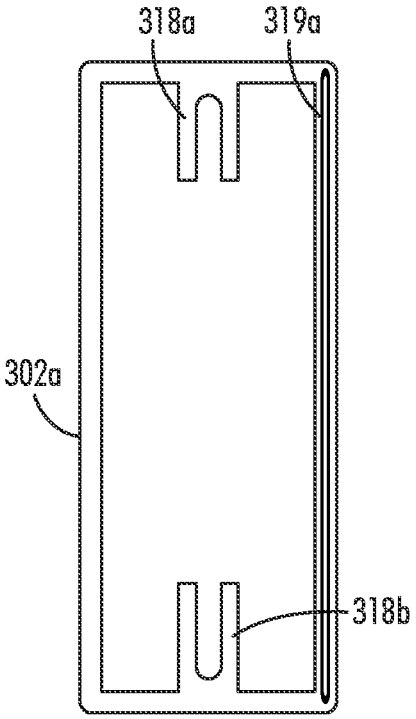
FIG.2A
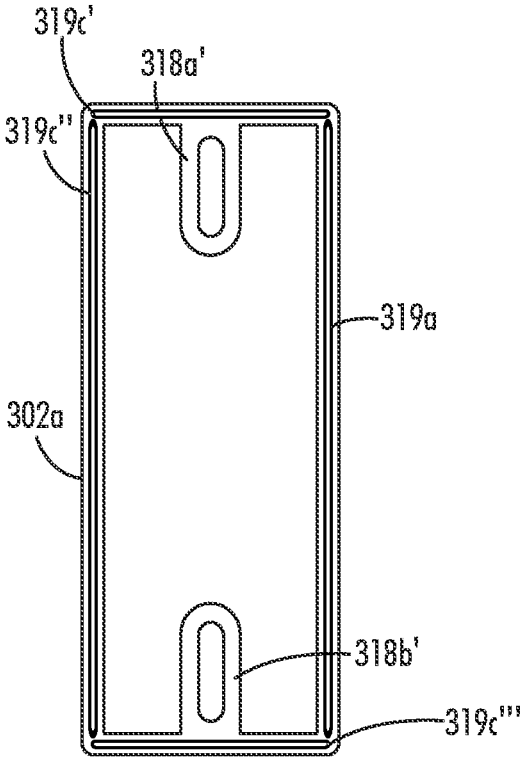
FIG.2C
FIG.2B
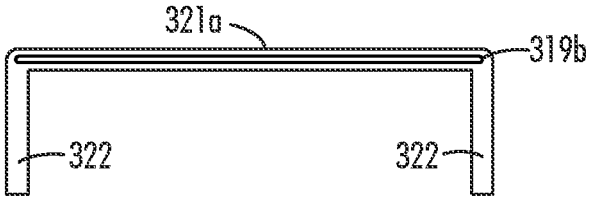
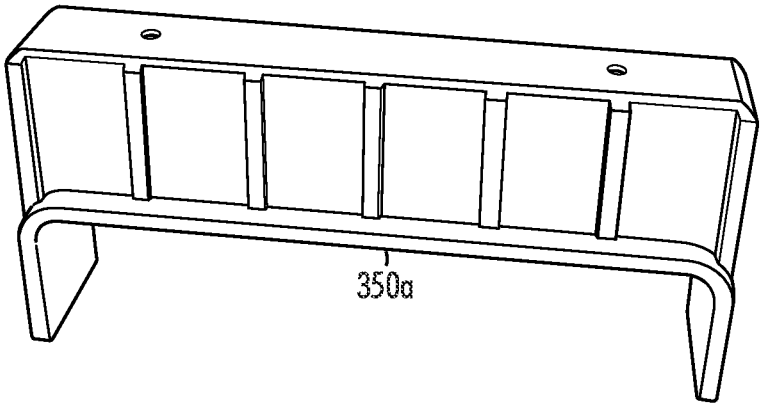
FIG.2D

STRUCTURALLY HARDENED PALLET ASSEMBLY AND COMPONENTS

CROSS-REFERENCE TO RELATED APPLICATIONS

This application is a continuation-in-part of U.S. patent application Ser. No. 18/451,636, filed on Aug. 17, 2023, entitled PALLET ASSEMBLY AND COMPONENTS THEREOF UTILIZING RECYCLED MATERIALS, of which claims priority to U.S. Pat. No. 11,807,417, filed on May 4, 2023, entitled PALLET ASSEMBLY AND COMPONENTS THEREOF, AND METHODS OF MANUFACTURING AND USING THE SAME, the contents of which is hereby incorporated in the entirety.

FIELD

This disclosure relates to transport structures or skids and components thereof, particularly, pallet assemblies for quick and efficient assembly, and for supporting goods in a stable fashion during transport from one destination to another destination. This disclosure also relates to components for a pallet assembly that can be easily transported and assembled on site, and methods of manufacturing and using the same.

BACKGROUND

A pallet (also called a skid) is a flat transport structure, which supports goods in a stable fashion while being lifted by a forklift, a pallet jack, a front loader, a jacking device, an erect crane, or any other piece of equipment for moving heavy or large objects.

A pallet is the structural foundation of a type of unit load and allows for handling and storage efficiencies. Goods in shipping containers are often placed on a pallet or other transport structure and secured with strapping, stretch-wrap, shrink-wrap, or equivalent. A unit load can be packed tightly into a warehouse rack, intermodal container, truck, boxcar, airplane, etc., yet can be easily broken apart at a distribution point, usually a distribution center, wholesaler, or retail store for sale to consumers or for use. Most consumer and industrial products move through the supply chain in a unit load for at least part of their transportation or distribution cycle. As such, unit loads make handling, storage, and distribution more efficient. They also help reduce handling costs and damage through bulk handling. About 2.0 billion unit loads are in daily use in the United States.

Pallets and other similar types of transport structures have dramatically supplanted older forms of transports structures like the wooden crate, box, or barrel. Pallets works well with modern packaging and transportation systems like corrugated boxes and intermodal containers commonly used for bulk shipping. In addition, pallet collars are commonly used to support and protect items shipped and stored on pallets. A typical pallet load might consist of corrugated fiberboard boxes stacked on a pallet or slip sheet and stabilized with stretch wrap, pressure-sensitive tape, strapping or shrink wrap.

While most pallets are wooden, pallets can also be made of plastic, metal, paper, and recycled materials. Wooden pallets typically include three or four stringers that support several deck boards or slats, on top of which the goods are placed, secured, and transported. In a pallet measurement, the first number is the stringer length and the second is the deck board or slat length.

Containerization for transport has spurred the use of pallets because shipping containers have the smooth, level surfaces needed for easy pallet movement and because pallets make it easier to move heavy stacks. Many pallets can handle a load of about 1,000.0 kilograms (kg) (about 2,200.0 pounds, lb.). Moreover, pallet loads can be hauled by forklift trucks of different sizes, or even by hand-pumped and hand-drawn pallet jacks. Some modern pallet standards are designed to allow the pallet load to pass through standard doorways. However, there are times when loads exceeding 1,000 kilograms may be necessary, and as such additional structural reinforcement or other materials may be required.

The lack of a single international standard for pallets causes substantial continuing expense in international trade. A single standard is difficult because of the wide variety of needs a standard pallet would have to satisfy. However, due to the International Plant Protection Convention (IPPC), most pallets shipped across national borders must be made of materials that are incapable of being a carrier of invasive species of insects and plant diseases. Pallets made of raw, untreated wood for example are not considered phytosanitary complaint. To be compliant the pallets (or other wood packaging material) must meet debarked standards and must be treated by either of the following means under the supervision of an approved agency: the wood must be heated to achieve a minimum core temperature of about 56.0° C. (132.8° F.) for at least about 30.0 minutes; or the wood must be fumigated with methyl bromide.

Therefore, there is a long sought need to find alternative solutions to traditional wood pallets, as well as increasing the resiliency of pallets to environmental conditions, and improving operating specifications to handle increased load weight. Furthermore, there is a long sought need to make such alternative solutions environmentally friendly, and to allow failed components to be broken down and upcycled.

SUMMARY

According to its major aspects and briefly recited, herein is disclosed a pallet assembly including a lineal engagement stringer, a lineal stringer, a lineal slat, and mechanical fasteners to securably fasten the first end of the lineal stringer to the lineal engagement stringer. The lineal engagement stringer has a profile comprising an internal space and a profile wall at least partially defining the internal space. The lineal stringer has a first end, a second end, a top wall defining a plurality of slots, and an internal screw boss. The lineal slat has a main wall and a leg configured to fit into a slot of the plurality of slots of the lineal stringer. Moreover, a portion of the main wall of the lineal slat is configured to sit on a portion of the top wall when the leg is pressed into the slot of the lineal stringer. Furthermore, the mechanical fastener traverses the profile wall of the lineal engagement stringer and engages with the internal screw boss of the lineal stringer. The lineal engagement stringer and/or the lineal stringer has one or more optional or non-optional target inserts that reinforce the lineal structure for loads and for lifting forces.

In some aspects, another pallet assembly is disclosed. The pallet assembly includes a lineal engagement stringer, a lineal stringer, a lineal slat, and mechanical fasteners to securably fasten the first end of the lineal stringer to the lineal engagement stringer. Each of the lineal engagement stringers, the lineal stringers, and the lineal slat includes an embedded multilayer composite strip or multiple embedded multilayer composite strips in order to provide increased strength and stiffness that reinforce the lineal structures for loads and for weight forces. The lineal engagement stringer also has a profile comprising an internal space and a profile wall at least partially defining the internal space. The lineal stringer has a first end, a second end, a top wall defining a plurality of slots, and an internal screw boss. The lineal slat has a main wall and a leg configured to fit into a slot of the plurality of slots of the lineal stringer. Moreover, a portion of the main wall of the lineal slat is configured to sit on a portion of the top wall when the leg is pressed into the slot of the lineal stringer. Furthermore, the mechanical fastener traverses the profile wall of the lineal engagement stringer and engages with the internal screw boss of the lineal stringer.

In some aspects, a method of assembling a pallet is provided. The method includes providing a lineal engagement stringer, a lineal stringer, a lineal slat, and providing a mechanical fastener. The method also includes securably fastening a first end of the lineal stringer to the lineal engagement stringer and pressing a leg of the lineal slat into a slot of the lineal stringer such that a portion of a main wall of the lineal slat sits on the portion of the top wall of the lineal stringer. The method also includes using the pallet components by stacking or nesting and transporting them or the assembled pallet. The method also includes the optional or non-optional step of placing a target insert within the internal space of the lineal engagement stringer (and/or the lineal stringer which also has an internal space partially defined by a profile wall) via a target, for example, along the length of the lineal structure, and/or mechanically fastening the target insert to the internal screw boss within the lineal structure.

These and other advantages will be apparent to those skilled in the art based on the following disclosure.

BRIEF DESCRIPTION OF THE DRAWINGS

Many aspects of the present disclosure will be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views. It should be recognized that these implementations and embodiments are merely illustrative of the principles of the present disclosure. Therefore, in the drawings:

FIG. 2A is a side view of an illustration of an example lineal engagement stringer, or of a lineal stringer, of an example pallet assembly according to the present disclosure;

FIG. 2B is a side view of an illustration of an example lineal slat of an example pallet assembly according to the present disclosure;

FIG. 2C is a side view of an illustration of another example lineal engagement stringer, or of another example lineal stringer, of an example pallet assembly according to the present disclosure;

FIG. 2D is a perspective view of an illustration of an example target insert of an example pallet assembly according to the present disclosure;

DETAILED DESCRIPTION

Figure 1A:
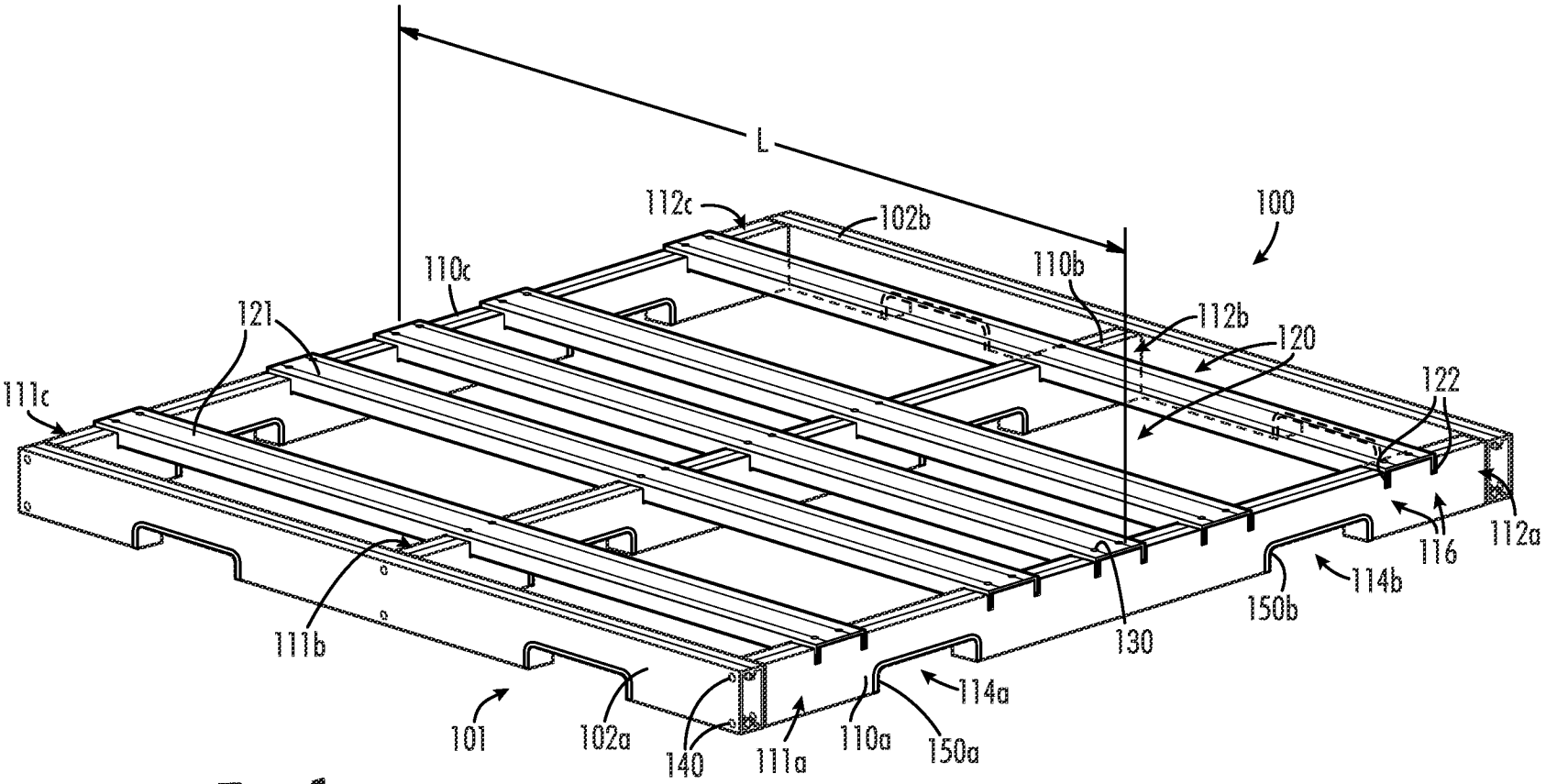
FIG. 1A is a perspective view of an illustration of an example pallet assembly according to the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Throughout this specification and the claims, the terms "comprise," "comprises," and "comprising" are used in a non-exclusive sense, except where the context requires otherwise. Likewise, the term "includes" and its grammatical variants are intended to be non-limiting, such that recitation of items in a list is not to the exclusion of other like items that can be substituted or added to the listed items.

I. EXAMPLE USE CASE SCENARIOS

The lack of a single international standard for pallets causes substantial continuing expense in international trade. A single standard is difficult because of the wide variety of needs a standard pallet would have to satisfy. However, due to the International Plant Protection Convention (IPPC), most pallets shipped across national borders must be made of materials that are incapable of being a carrier of invasive species of insects and plant diseases. Pallets made of raw, untreated wood for example are not considered phytosanitary compliant. Moreover, wood pallets can pose serious bio-hazard risks as they are susceptible to bacterial and chemical contamination, such as *E. coli* problems in food and produce transportation, and even insect infestation.

To be phytosanitary compliant, wood pallets (or other wood packaging material) must meet debarked standards and must be treated by either of the following means under the supervision of an approved agency: heated to achieve a minimum core temperature of about 56.0° C. (132.8° F.) for at least 30 minutes; or fumigated with methyl bromide (except within all EU member states).

Pallets (also described as pallet assemblies herein) made of non-wood materials such as steel, aluminum, plastic, engineered wood products, such as plywood, oriented strand board, or corrugated fiberboard, or as shown and described herein do not need IPPC approval, and are considered to be exempt from certain phytosanitary regulations. Despite the above, the production of pallets accounts for about 43.0% of hardwood and about 15.0% of softwood usage in the U.S.

The reason for this is simple: the cheapest pallets are made of softwood and are often considered expendable, to be discarded as trash along with other wrapping elements, at the end of transport from one location to another. These pallets are simple stringer pallets, and able to be lifted from two sides.

Slightly more complex, hardwood block pallets, plastic pallets, and metal pallets can be lifted from all four sides. These costlier pallets usually require a deposit and are returned to the sender or resold as used. Many "four way" pallets are color-coded according to the loads they can bear, and other attributes.

Synthetic pallets are often made of synthetic or recycled materials. They are usually durable, long-lasting, chemically inert, and are typically weather, water, rot, and corrosion-resistant. However, they usually involve relatively complex and expensive manufacturing methods for mass production when compared to wood or semi-organic pallets for the same strength and stability.

As such, in at least one aspect, the disclosure herein is directed to improved transport structures or skids, in particular, to pallet assemblies and pallet components, and to improved methods of producing and assembling the same. In the same vein, the lessons and techniques disclosed herein are applicable to any transport structure or support structure.

II. SYSTEMS AND METHODS

In one aspect, the transport structure or skid according to the present disclosure is a multi-component system that allows for rapid assembly, use, and/or disassembly of the structure. The transport structure or skid, in one aspect, includes a plurality of extruded or pultruded components that are free of biological activity and exempt from phytosanitary regulations or equivalent (herein referred to as "inert"). These components can be easily transported (stacked or nested, for example) and assembled on site. In another aspect, the transport structure or skid is a pallet assembly of the stringer type, as is understood in the art. In another aspect, the pallet assembly is a block type pallet assembly, as is understood in the art, or any other type of pallet assembly (e.g., skid pallets, carrier pallet, flush pallet, perimeter base pallet, two-way or four-way) made possible with the inert, extrusion or pultrusion components according to the present disclosure.

In one aspect, the pallet assembly according to the present disclosure includes an inert frame and one or more inert support surfaces attached thereto. The pallet assembly, in one aspect, includes a frame formed by two, engagement structures (or "engagement stringers", as referred to herein) having a plurality of perpendicular engagement structures or "stringers" therebetween and engaged, respectively, to each engagement stringer. The frame may be formed by block components or any other type(s) of components called for by the different types of pallet assemblies. Moreover, the frame or the frame components, in another aspect, may be further processed (e.g., cut, sheared, sawed, etched, chamfered, notched, bent, drilled, bored, built-up, chemically prepared, etc.) as need. Furthermore, the frame or the frame components may be further processed to include internal structures (embedded or removable/replaceable) or target inserts that are the same or a different material, for example, than the frame or the frame components. In one aspect, the one or more support surfaces are a plurality of deck boards or top slats supported and retained/held directly by the frame. The deck board(s) or top slats may include a structure that is complementary to a feature defined by the frame and that allows the deck board(s) or top slats to mate with and be held by the frame. In another aspect, the pallet assembly demands fasteners only for assembling the frame. In another aspect, the pallet assembly has optional or non-optional fasteners for attaching the deck board(s) or top slats to the frame for added rigidity and stability.

In one aspect, the stringers and the top slats are each lineal construction members produced from an extrusion or pultrusion manufacturing process using inert materials. The components for the pallet assembly in the form of lineal members may be made at least in part of polymeric materials or equivalent, e.g., low-density polyethylene (LDPE) (a chemically inert, flexible, insulator), high-density polyethylene (HDPE) (inert, thermally stable, tough and high tensile strength); polypropylene (resistant to acids and alkalis, high tensile strength); polyvinyl chloride (PVC) (insulator, flame retardant, chemically inert); polychlorotrifluoroethylene (PCTFE) (stable to heat and thermal, high tensile strength and non-wetting); polyamide (Nylon) (high melting point, excellent abrasion resistance); polyethylene terephthalate (PET) & (PETG) (High strength and stiffness, broad range of use temperatures, low gas permeability), etc. The components for the pallet assembly also may be made of recycled materials or may incorporate internal reinforcement such as embedded reinforcement fibers as is understood in the art or multilayer composite strips according to the present disclosure. The components for the pallet assembly, in another aspect, may be formed entirely of rolled metal, in particular, rolled steel or steel alloys or sheet metal. The components for the pallet assembly, in another aspect, may be formed of "color-blend" recycled plastics or polymers as is known in the art. The components for the pallet assembly, in another aspect, may be formed of scrap carbon fiber, and fiber glass and glass fibers, as well as any other polymers and/or any other natural (e.g., plant-based or plant derived) or non-natural fiber(s).

The engagement stringers, in one aspect, serve to receive and hold the only mechanical fasteners demanded by the pallet assembly (for securably attaching the stringers). In another aspect, the pallet assembly calls for mechanical fasteners for the top slats and/or any other component of the assembly (e.g., any other slats, the target inserts). In another aspect, the stringers define a slot(s) for receiving and holding the top slats. In another aspect, the components for the pallet assembly include bottom slats and the stringers also define a slot(s) for receiving and holding the bottom slats opposite the top slats. In another aspect, each of the stringers defines a targets to facilitate engagement of the pallet assembly with lift, move, and/or transport equipment.

In particular, in one aspect, each of the engagement stringers and/or each of the stringers includes a screw boss(es) to receive the assembly screws. In another aspect, the screw boss(es) and assembly screws help to securably attach each of the stingers, respectively, to each of the engagement stringers to form the frame. Importantly, assembly screws may be driven into the screw boss(es) that are exposed at the ends of the stringer. The assembly screws also may be driven (e.g., from the side(s) or from within at any point along the length of the stringer, for example, into the internal screw boss (the entire screw boss extending along a length of the stringer).

In one aspect, each of the slats is configured as a flat lineal platform having two legs. In this way, the cross-section of the slat along its length is generally II-shaped. Moreover, each of the legs of the slat is configured to fit (e.g., loosely fit, friction fit, press fit, snap fit, wedge fit) into each of the slots defined by the stringers. As such, the slats are supported and held directly by the stringers of the frame, and the slats provide a flat support surface for the pallet.

In one aspect, the pallet assembly and/or the pallet component(s) incorporate or is made of a non-homogeneous composition of matter having both compressive strength and stiffness which enables it to be used as a substitute for wood in a wide variety of applications. In another aspect, the structural composite for the pallet component(s) according to the present disclosure can substitute for other materials with higher strength modulus than wood, such as aluminum. In another aspect, the pallet assembly and any of the pallet assembly component(s) described herein incorporate(s) one or more multilayer composite strip(s) that are made of or are inclusive of the non-homogenous composition of matter according to the present disclosure.

In particular, in one aspect, the pallet assembly and/or the pallet component(s) are engineered, meaning that its exterior shape and the choice of its external or internal features or components (e.g., screw boss(es), top guide(s), screw line(s)) and their locations and shapes are based at least in part on the demands as specified herein. The pallet assembly and/or the pallet component(s) may be extruded or pultruded lineal composite structures produced with embedded reinforcement(s) that are spaced away from the neutral axis, analogous to the flanges on and I-beam, or asymmetrically situated, in order to provide increased strength and stiffness in one or both axes perpendicular to the cross-section. Because such a structural composite may be designed for load-bearing, the composition is referred to herein as a structural composite.

In one aspect, the pallet assembly and/or the pallet component(s) incorporate or is made of a structural polymeric composite including a stiffening layer(s). The composite may be manufacturing via a continuous extrusion pultrusion method in which the stiffening layer is pulled through a cross-head die as a polymer(s) is/are extruded over it. The stiffening layer may include a film or textile carrier, a filler of carbon fibers, fiberglass, and organic fibers or minerals forming a mat. A binder may be dispersed over the mat and a second carrier applied. The mat may be subjected to heat and pressure to soften the carriers and binder so they penetrate into the interstices of the filler and binds mechanically with them and the carriers and binder bind chemically with each other to form the stiffening layer. A polymer may then be extruded over the stiffening layer, which may be used flat, provided with holes or punches for composite action with the polymer, formed into profile, or segmented to provided spaced-apart stiffening layers.

In one aspect, the pallet assembly and/or the pallet component(s) incorporate or is made of a structural polymeric composite including at least one stiffening layer that increases the stiffness of the finished structural composite. A stiffening layer is incorporated into a polymeric extrusion either by extruding the polymer onto the stiffening layer so that the stiffening layer is on one side and the polymer on the other and therefore the stiffening layer is visible from the exterior, or by extruding it so that the polymer partly or wholly surrounds the stiffening layer, in which case the stiffening layer may not be visible from the exterior.

In one aspect, the pallet assembly and pallet component(s) incorporate a multilayer composite strip(s) having a first polymeric layer, a first mesh layer, a composite layer of shredded fibrous material (carbon fiber, bast fiber, etc) and polymeric material, and a second mesh layer, and a second polymeric layer. The multilayer composite strip is formed by heating, cooling, and/or compressing, including rolling and stretching to form a rigid composite strip that may be further mechanically or chemically bonded to other polymers or building materials so as to increase stiffness and restrain lateral movement. Such composite strip is often comprised of the first polymeric layer consisting of PET, and a vinyl or metal mesh layer, wherein the PET is melted into the mesh layer, and forms a receiving layer in which fibrous material such as chopped carbon fiber may be applied, and said second mesh layer and second polymeric layer covering the fibrous material, all of which is rolled and heated to form a composite strip that provides restraint in all directions and increased rigidity.

The multilayer composite strip may further provide impact resistance and crush resistance, and allows for strengthening and hardening the pallet assembly as disclosed herein. In one aspect, a pallet assembly may be utilized to move heavy metallic items such as ammunition, weapons, or other metallic items that would cause sag or creep in the components. Applying the multilayer composite strip helps to increase working capacities, and depending on the size of the multilayer composite strip, may double the working capacity of wooden pallets (1,000 kilograms).

In one aspect, the pallet assembly and pallet component(s) incorporate a multilayer composite strip(s) having a first polymeric layer with a layer height ranging from between about 0.23 mm to about 1.1 mm; a first mesh layer, wherein at least about 20.0 percent of the first mesh layer is a void region; a composite layer of shredded fibrous material and polymeric material, wherein the shredded fibrous material is of an average length between about 5.0 mm and about 50.0 mm, and the polymeric material has a granular size from between about 50.0 microns to about 2000.0 microns prior to heating; a second mesh layer, wherein at least about 20.0 percent of the second mesh layer is a void region; and a second polymeric layer with a layer height from between about 0.23 mm to about 1.1 mm.

In one aspect, the pallet assembly and pallet component(s) incorporate polyvinyl chloride (PVC) and/or recycled PVC.

In one aspect, the pallet assembly and pallet component(s) incorporate polyamides.

In one aspect, the pallet assembly and pallet component(s) incorporate a shredded fibrous material, for example, shredded carbon fiber.

In one aspect, the pallet assembly and pallet component(s) incorporate a shredded fibrous material, for example, shredded fiberglass.

In one aspect, the pallet assembly and pallet component(s) incorporate a shredded fibrous material, for example, shredded bast fibre.

In one aspect, the multilayer composite incorporates a first polymeric layer and a second polymeric layer of polyethylene terephthalate (PET) or polyethylene terephthalate glycol (PETG).

In one aspect, the multilayer composite incorporates a first polymeric layer of PVC and/or recycled PVC.

In one aspect, the multilayer composite incorporates a first polymeric layer further including polyamides.

In one aspect, the multilayer composite incorporates a first mesh layer and a second mesh layer having a window size between 1 mm to 12 mm.

In one aspect, the multilayer composite incorporates a shredded fibrous material, for example, shredded carbon fiber.

In one aspect, the multilayer composite incorporates a shredded fibrous material, for example, shredded fiberglass.

In one aspect, the multilayer composite incorporates a shredded fibrous material, for example, shredded bast fibre.

In one aspect, the multilayer composite incorporates a third mesh layer, a second composite layer of the shredded fibrous material and the polymeric material, and a third polymeric layer, the second composite layer being of a different shredded fibrous material than the first composite layer.

In one aspect, the multilayer composite incorporated into pultruded or extruded pallet components, and wherein the multilayer composite strip(s) is/are between about 1.0 mm to about 20.0 mm in height and up to about 550.0 mm in width.

In some aspects, the multilayer composite described herein, wherein the first and second mesh layer have a tensile strength of 9,000.0 psi.

In some aspects, the multilayer composite described herein, wherein the multilayer composite is water resistant and noncorrosive.

In some aspects, the multilayer composite described herein, wherein the first polymeric layer, the first mesh layer, the composite layer, the second mesh layer, and the second polymeric layer are integrated to form a solid layer.

In one aspect, the multilayer composite incorporates a first polymeric layer with a layer height ranging from between about 0.23 mm to about 1.1 mm; a first mesh layer of fiberglass, wherein at least about 20.0 percent of the first mesh layer is a void region; a composite layer of shredded fibrous material and polymeric material, wherein the shredded fibrous material is of an average length between about 5.0 mm and about 50.0 mm, and the polymeric material has a granular size from between about 50.0 microns to 2000.0 microns prior to heating; a second mesh layer of fiberglass; and a second polymeric layer with a layer height from between about 0.23 mm to about 1.1 mm.

Referring to methods herein, in one aspect, a method of assembling a pallet is disclosed. In one aspect, the method comprises providing a lineal engagement stringer, a lineal stringer, a lineal slat, and providing a mechanical fastener. The method also comprises, in another aspect, securably fastening a first end of the lineal stringer to the lineal engagement stringer and pressing a leg of the lineal slat into a slot of the lineal stringer such that a portion of a main wall of the lineal slat sits on the portion of the top wall of the lineal stringer.

In one aspect, a method of using the pallet components is disclosed. In another aspect, the pallet components are stacked or nested and transported in a box. The stacked and/or nested pallet components conserve space and allow for ready and fast assembly on site.

III. WITH REFERENCE TO THE FIGURES

U.S. patent application Ser. Nos. 18/451,636, and 18/143,185 are assigned to the Applicant of the present application, and are incorporated herein in their entirety by reference.

The term "extruded" is used herein for convenience but engagement stringers, stringer, and slats may be formed in any way customary in the industry, for example, pultruded and co-extruded with other materials. Resin fusion and vacuum fusion methods are also envisioned.

The term "lineal" is used herein to refer to an extruded pallet component having a uniform cross section perpendicular to its major dimension which major dimension is much longer than its other two dimensions; that is, the plane of any cross section perpendicular to the major dimension of the pallet component is defined by a line parallel to the major dimension.

The term "non-homogeneous" as used herein means that at least some of the constituents are concentrated within the structural composite rather than being homogeneously dispersed.

The term "screw boss" is a physical structure that grips the threads of a screw being driven into it so that, once the screw has been inserted into or through the screw boss, the screw boss resists the removal of the screw more when the screw is pulled than when the screw is unscrewed.

An "insertable screw boss" is a screw boss that has been separately extruded, molded, cast, forged, or welded so that it can be inserted into a channel and is otherwise functionally the same as a screw boss extruded as an integral part of that channel, but allowing for further strengthening or reinforcing.

A "mechanical fastener" is a mechanism or structure that helps to fasten to items or two components together, and may include but is not limited to screws, nails, bolts, pegs, mating structures, snap or button mechanisms, etc.

Accordingly, a user, a business, a military contractor, and/or any of the armed services can affectively manufacture, stack/nest, assemble, use, disassemble, store, and/or recycle the pallet components for the pallet assembly based on the systems and methods of the present disclosure. The pallet components and the resulting pallet assemblies according to the present disclosure are lighter, stronger (i.e., can hold more total weight than a comparably structured stringer pallet, for example) and take up less space than conventional pallet components or pallet assemblies. The pallet components and the resulting pallet assemblies according to the present disclosure allow for ready and efficient transport of pallet components on site, as needed, and rapid assembly/disassembly and use of those components and resulting pallets. All these advantages made possible with readily-available and/or recycled inert materials that are not at risk for chemical or biological impregnation or infestation.

Referring now to FIG. 1A, a perspective view of an illustration of an example pallet assembly according to the present disclosure is shown. In particular, in FIG. 1A there is shown a multi-component, stringer type, two-way pallet assembly 100 assembled from a plurality of extruded lineal components made of inert materials, namely, recycled PVC and fiber.

As illustrated in FIG. 1A, the pallet assembly 100 includes a frame 101 and a support surface 120 attached to the frame 101. More specifically, in FIG. 1A, the frame 101 includes two or more engagement stringers 102, in particular, a first engagement stringer 102*a* arranged opposite and parallel to a second engagement stringer 102*b*, and a plurality of perpendicular stringers 110 engaged, respectively, to each of the engagement stringers 102*a*, 102*b*. Moreover, and with further specificity, each of the plurality of stringers 110 (in particular, each of a first stringer 110*a*, a second stringer 110*b*, and a third stringer 110*c*, which are arranged in parallel) of the frame 101 has a first end 111 and a second end 112, and each first end 111 of the stringers 110*a*, 110*b*, 110*c* is engaged to the first engagement stringer 102*a* and each second end 112 of the stringers 110*a*, 110*b*, 110*c* is engaged to the second engagement stringer 102*b*. Each of the plurality of stringers 102, 110 also is processed to include two or more cut-out targets 114, in particular, a first target 114*a* and a second target 114*b* each configured to receive an injection molded target insert 150 (best seen in FIG. 2B) to reinforce the stringer 110 and to facilitate lifting of the resulting pallet assembly 100 by forklift. Each of the plurality of stringers 110 also is processed to include a plurality of surface features 116 or slots (best seen in FIG. 4A) that allows the support surface 120 to mate with and be held by the frame 101.

Depending on the embodiment, additional stringers 110 may be part of the pallet assembly 100 and be similarly situated and engaged between the engagement stringers 102 (i.e., the engagement stringers 102 being longer and/or the spacing of the stringers 110 being different than that illustrated). Furthermore, depending on the embodiment, additional engagement stringers 102 (and/or longer mechanical fasteners 140, as discussed in greater detail herein; see FIG. 3) may be part of the pallet assembly 100, and used to double-up or reinforce the first engagement stringer 102*a* and/or the second engagement stringer 102*b*. Moreover, the frame or the frame components may be further processed (e.g., cut, sheared, sawed, etched, chamfered, bent, drilled, bored, built-up, chemically prepared, etc.). Furthermore, each of the engagement stringers 102, each of the stringers 110, and/or each of the top slats 121 may incorporate embedded reinforcement fibers, strands, or rebar-like lineal structures or multilayer composite strip(s) (as discussed in greater detail herein; see FIGS. 2C, 2E) according to the present disclosure. Depending on the embodiment, each of the engagement stringers 102, each of the stringers 110, and/or each of the top slats 121 may be formed entirely of rolled metal instead of being an extrusion or pultrusion product.

Returning to FIG. 1A, the support surface 120 includes a plurality of top slats 121 configured to be engaged/retained and directly supported by the plurality of stringers 110 of the frame 101. In particular, in FIG. 1A, each of the top slats 121 also is configured as a flat lineal platform having two legs 122 and having a cross-section along its length, L, that is generally II-shaped, and complementary to the slots 116 defined by each of the stringers 110. As such, each of the legs 122 of each of the top slats 121 is configured to fit into each of the slots 116. The top slats 121, in this way, are supported and held directly by the frame 101. The top slats 121 also provide a stable and secure flat support surface 120.

Figure 1B:
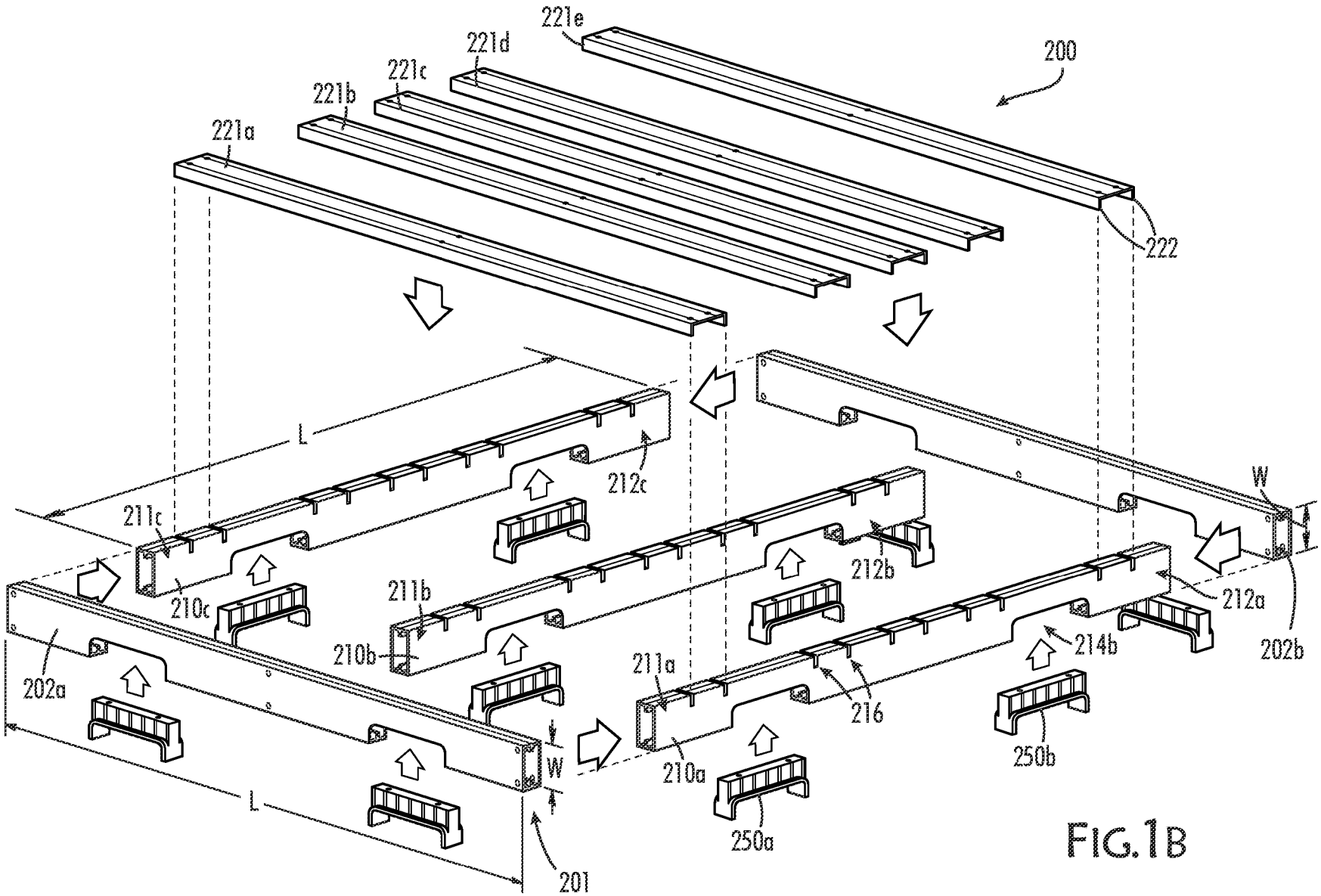
FIG. 1B is a perspective view of an exploded illustration of an example pallet assembly according to the present disclosure.

Referring now to FIG. 1B, a perspective view of an exploded illustration of an example pallet assembly according to the present disclosure is shown. In particular, in FIG. 1B, there is shown a multi-component, stringer type, two-way pallet assembly 200 having an engagement stringer 202*a* arranged opposite and parallel to a second engagement stringer 202*b*; and a first stringer 210*a*, a second stringer 210*b*, and a third stringer 210*c* arranged in parallel between the engagement stringers 202*a*, 202*b*. As illustrated, the first stringer 210*a*, the second stringer 210*b*, and the third stringer 210*c* are to be engaged, respectively, via mechanical fasteners 240, to each of the engagement stringers 202*a*, 202*b* to form a frame 210. Moreover, a plurality of top slats 221, in particular, a first top slat 221*a*, a second top slat 221*b*, a third top slat 221*c*, a fourth top slat 221*d*, and a fifth top slat 221*e* (each having two legs 222 that are complementary to the slots 216 defined by each of the stringers 210), are to be fit into each corresponding slot 216 and placed on the first stringer 210*a*, the second stringer 210*b*, and the third stringer 210*c*.

Moreover, and with further specificity, each of the plurality of stringers 210*a*, 210*b*, 210*c* has a first end 211 and a second end 212, and each first end 211 of the stringers 210*a*, 210*b*, 210*c* is to be engaged to the first engagement stringer 202*a* (via the mechanical fasteners 240*a*) and each second end 212 of the stringers 210*a*, 210*b*, 210*c* is to be engaged to the second engagement stringer 202*b* (via the mechanical fasteners 240*b*) to form the frame 201. Each of the plurality of stringers 202, 210 also are processed to include a first cut-out target 214*a* and a second target 214*b* each configured to receive an injection molded target insert 250*a*, 250*b* to reinforce the stringers 202, 210 and to facilitate lifting of the resulting pallet assembly 200 by forklift. Each of the plurality of stringers 210 also is processed to include a plurality of slots 216 (best seen in FIG. 4A) that allows the plurality of top slats 221 to mate with and be held by the frame 201 (via the mechanical fasteners 230, for example).

Returning generally to FIG. 1B, the first engagement stringer 202*a* and the second engagement stringer 202*b* serve to receive and hold the mechanical fasteners 240 for securably attaching each of the first stringer 210*a*, the second stringer 210*b*, and the third stringer 210*c*. Depending on the embodiment, each of the engagement stringers 202 and/or each of the stringers 210 include a screw boss(es) (best seen in FIG. 3) to receive the mechanical fasteners 230, 240 or any other mechanical fasteners (best seen in FIGS. 3 and 4A). Importantly, as illustrated in FIG. 1B, the mechanical fasteners 230, 240 may be driven into the screw boss(es) (the entire screw boss extending along the length, L, of the stringers 210) within each of the stringers 202, 210.

Figure 1C:
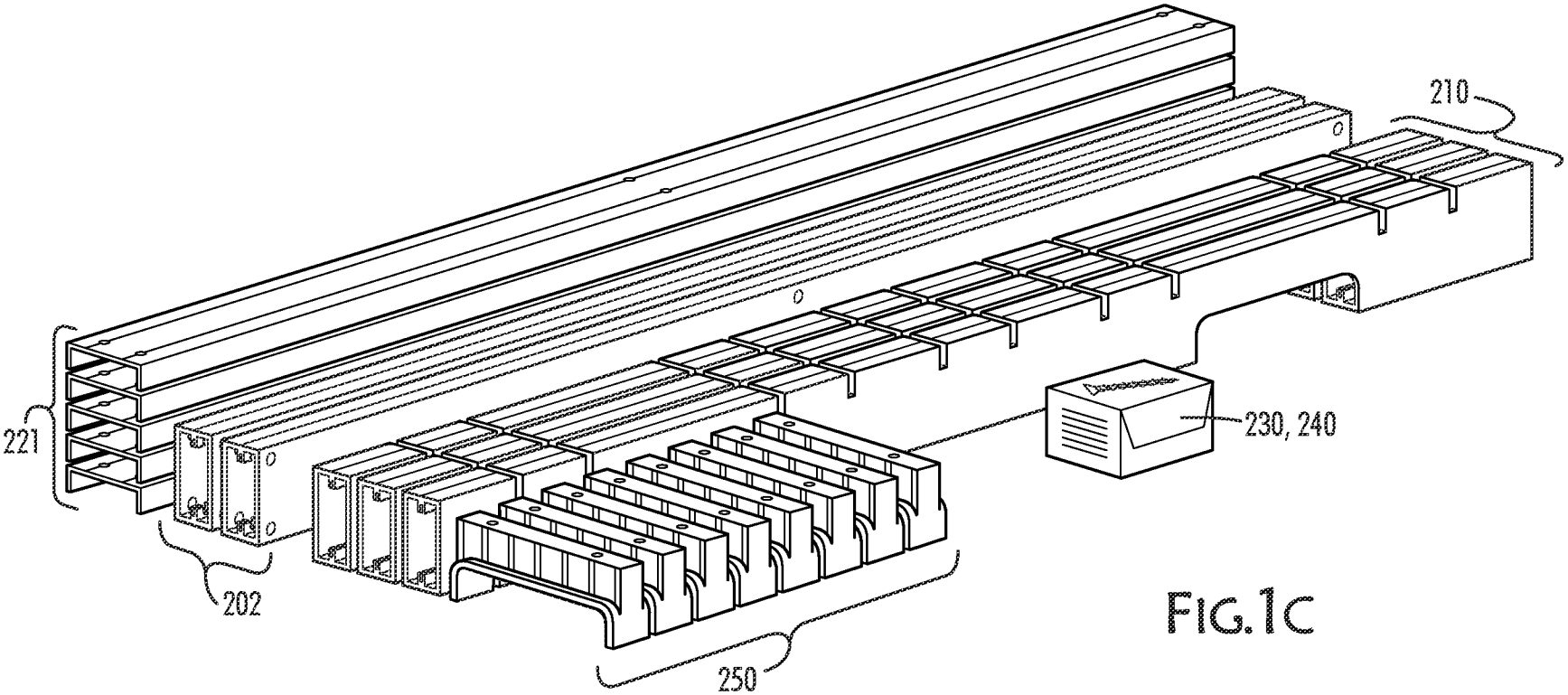
FIG. 1C, a perspective view of an illustration of the example pallet assembly of FIG. 1B organized as a kit and ready to be shipped in a box along with a box of mechanical fasteners according to the present disclosure.

Referring now to FIG. 1C, a perspective view of an illustration of the example pallet assembly of FIG. 1B organized as a kit and ready to be shipped in a box is shown. In particular, in FIG. 1C, there is shown the multi-component, stringer type, two-way pallet assembly 200 of FIG. 1B. The engagement stringers 202 are arranged together, as are the stringers 210. The plurality of top slats 221 are stacked, and the injection molded target inserts 250 are together. Moreover, the mechanical fasteners 230, 240 are in a box. Together, all of the components are arranged such that they can be packed and shipped for fast and ready assembly.

Figure 2E:
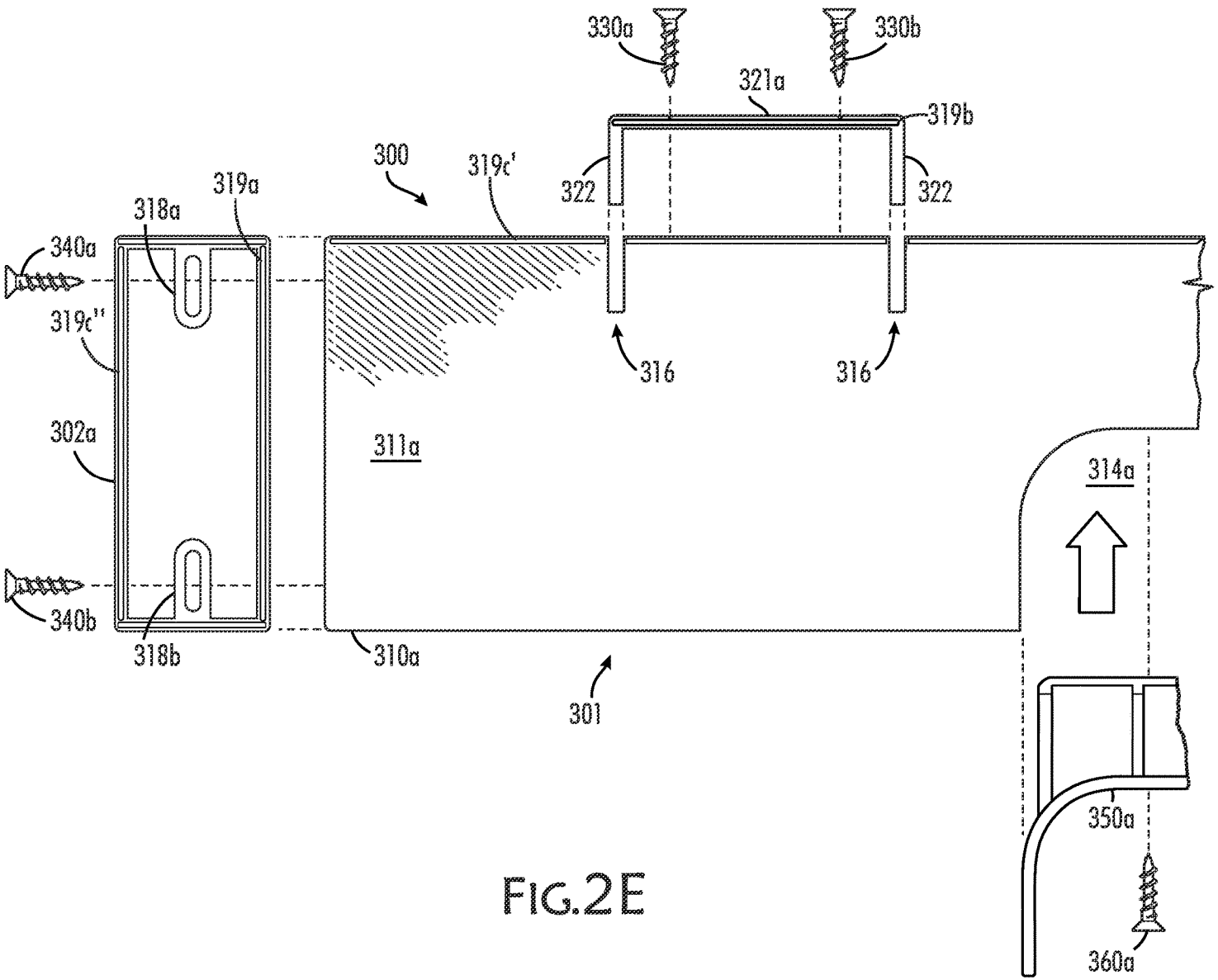
FIG. 2E is a side view of a partial, exploded illustration of an example corner of an example frame of an example pallet assembly according to the present disclosure.

Referring now to FIG. 2, a side view of an illustration of an example engagement stringer, or of a stringer, of an example pallet assembly is shown in FIG. 2A; a side view of an illustration of an example slat of an example pallet assembly is shown in FIG. 2B; a side view of an illustration of another example engagement stringer, or of another example stringer, of an example pallet assembly is shown in FIG. 2C; a perspective view of an illustration of an example target insert of an example pallet assembly is shown in FIG. 2D; and a side view of a partial, exploded illustration of an example corner of an example frame of an example pallet assembly is shown in FIG. 2E, according to the present disclosure. In particular, FIG. 2A and FIG. 2C are each, respectively, a side view of an example first lineal engagement stringer 302*a* according to the present disclosure; however, each could be a side view of an example first lineal stringer 310*a*. Moreover, as illustrated, the side views of FIG. 2A and FIG. 2C are from the perspective of a first end 311 (opposite a second end 312; not shown) of the first engagement stringer 302*a*. As such, in one aspect of the pallet assembly of the present disclosure, both the first engagement stringer 302*a* and the first stringer 310*a* have the same hollowed profile type as shown for 302*a* in FIG. 2A or 2C. In another aspect of the pallet assembly of the present disclosure, the first engagement stringer 302*a* may have a side view as shown in FIG. 2A, and the first stringer 310*a* may have a side view as shown in FIG. 2C, or vice versa.

Figure 3:
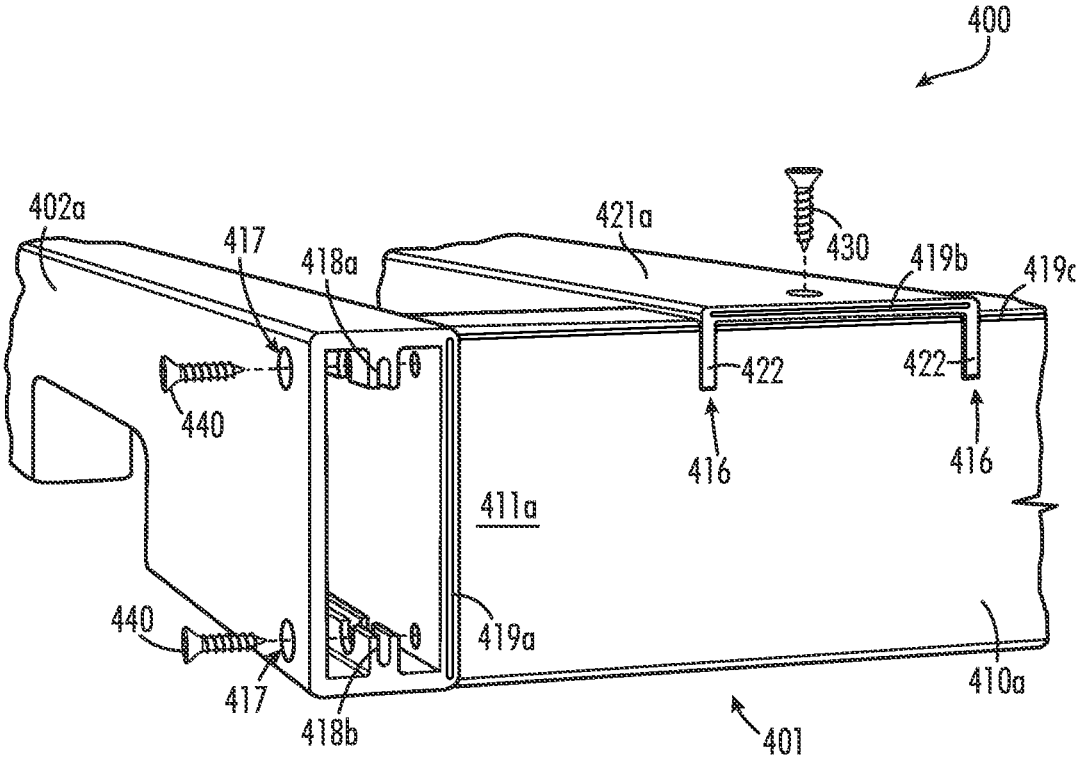
FIG. 3 is a perspective view of a partial illustration of an example corner of an example frame of an example pallet assembly according to the present disclosure.

More specifically, as shown in FIG. 2A, the first engagement stringer 302*a* has internal screw bosses 318*a*, 318*b* to receive mechanical fasteners (for example, for receiving a portion of the mechanical fasteners 340 as shown in FIG. 2E), and has an embedded multilayer composite strip 319*a*. Importantly, similar to the illustration of FIG. 2E, individual mechanical fasteners 340 may be driven through the screw bosses 318*a*, 318*b* of the first engagement stringer 302*a*, for example, into the screw bosses 318*a*', 318*b*' that are exposed at the ends of a first stringer 310*a*. In particular, as shown in FIG. 3, the individual mechanical fasteners 340*a* and 340*b* may be driven at two pre-drilled points (best seen in FIG. 3) along the width, W, of the first engagement stringer 302*a* and through the internal screw bosses 318*a*, 318*b* (the screw bosses extending along the length, L, of the first engagement stringer 302*a*, for example). Moreover, the individual mechanical fasteners 340 may then continue to be driven (best seen in FIG. 3) through the embedded multilayer composite strip 319*a* of the first engagement stringer 302*a* and into the internal screw bosses 318*a*', 318*b*' of the first stringer 310*a*, etc.

As shown in FIG. 2B, a first top slat 321*a* has an embedded multilayer composite strip 319*b*. Importantly, similar to the illustration of FIG. 2E, individual mechanical fasteners 330*a* and 330*b* may be driven through the embedded multilayer composite strip 319*b* of the first top slat 321*a*, for example, into the screw bosses 318*a*', 318*b*' of a first stringer 310*a*. In particular, as shown in FIG. 2E, the individual mechanical fastener(s) 330*a* and 330*b* may be driven at two pre-drilled points (best seen in FIG. 2E; FIG. 3 shows one pre-drilled point for only one mechanical fastener 430) through the embedded multilayer composite strip 319*b*, and through an embedded multilayer composite strip 319*c*' and then into the internal screw bosses 318*a*', 318*b*' of the first stringer 310*a*.

As shown in FIG. 2C, in another aspect, the first engagement stringer 302*a* or the first string 310*a* has rounded internal screw bosses 318*a*', 318*b*' to receive mechanical fasteners (for example, for receiving a portion of the mechanical fasteners 340 as shown in FIG. 2E), and has an embedded multilayer composite strip 319*a* (right side) and any or all of embedded multilayer composite strips 319*c*' (top), 319*c*" (left side), and/or 319*c*'" (bottom). Importantly, similar to the illustration of FIG. 2E, individual mechanical fasteners 340 may be driven through the rounded screw bosses 318*a*, 318*b* of the first engagement stringer 302*a*, for example, into the rounded (or non-rounded) screw bosses 318*a*', 318*b*' that are exposed at the ends of a first stringer 310*a*. In particular, as shown in FIG. 2E, the individual mechanical fasteners 340*a* and 340*b* may be driven at two pre-drilled points along the width, W, of the first engagement stringer 302*a* and through the optional embedded multilayer composite strip 319*c*" and driven through the internal screw bosses 318*a*, 318*b* (the screw bosses extending along the length, L, of the first engagement stringer 302*a*, for example). Moreover, as shown in FIG. 2E, the individual mechanical fasteners 340 may then continue to be driven through the multilayer composite strip 319*a* of the first engagement stringer 302*a* and into the internal screw bosses 318*a*', 318*b*' of the first stringer 310*a*, etc.

In FIG. 2E, there is shown an example corner of an example frame of an example pallet assembly 300 having a first engagement stringer 302*a*, a first top slat 321*a*, a first stringer 310*a*, and mechanical fasteners 330, 340. More specifically, as illustrated, the side view of FIG. 2E is from the perspective of a first end 311*a* (opposite a second end 312*a*; not shown) of the first engagement stringer 302*a*. The side view of FIG. 2E also shows an example of an injection molded target insert 350*a* for a first target 314*a* at a first end 311 of the of the stringer 310*a*.

Even more specifically, as shown in FIG. 2A-2E in one aspect, the engagement stringers 302 and the stringers 310 each have internal screw bosses 318*a*/318*a*', 318*b*/318*b*' to receive mechanical fasteners 330, 340 (or a portion of the mechanical fasteners 330, 340), and each have an embedded multilayer composite strip 319 that lies parallel to the stacked screw bosses 318*a*, 318*b* of the pallet components, and optional embedded multilayer composite strip(s) on the top, bottom, and/or side(s), in order to provide increased strength and stiffness. Importantly, individual mechanical fasteners 340*a*, 340*b* are driven through the screw bosses 318*a*/318*a*', 318*b*/318*b*' of the engagement stringer 302*a* and, for example, into the screw bosses 318*a*/318*a*', 318*b*/318*b*' that are exposed at the ends of the stringer 310*a*. Each of the composite strips 319 operates as a stiffening layer for each of the lineal pallet components. Depending on the embodiment, each of the composite strips 319 may have a first polymeric layer, a first mesh layer, wherein at least 20 percent of the first mesh layer is a void region, a composite layer of shredded fibrous material and polymeric material, and a second mesh layer, and a second polymeric layer; or may have a first polymeric layer with a layer height ranging from between about 0.23 mm to about 1.1 mm; a first mesh layer, wherein at least about 20.0 percent of the first mesh layer is a void region; a composite layer of shredded fibrous material and polymeric material, wherein the shredded fibrous material is of an average length between about 5.0 mm and about 50.0 mm, and the polymeric material has a granular size from between about 50.0 microns to about 2000.0 microns prior to heating; a second mesh layer, wherein at least about 20.0 percent of the second mesh layer is a void region; and a second polymeric layer with a layer height from between about 0.23 mm to about 1.1 mm; or may have a first polymeric layer with a layer height ranging from between about 0.23 mm to about 1.1 mm; a first mesh layer of fiberglass, wherein at least about 20.0 percent of the first mesh layer is a void region; a composite layer of shredded fibrous material and polymeric material, wherein the shredded fibrous material is of an average length between about 5.0 mm and about 50.0 mm, and the polymeric material has a granular size from between about 50.0 microns to 2000.0 microns prior to heating; a second mesh layer of fiberglass; and a second polymeric layer with a layer height from between about 0.23 mm to about 1.1 mm.

Referring now to FIG. 3, a perspective view of a partial illustration of an example pallet assembly according to the present disclosure is shown. In particular, in FIG. 3, there is shown a pallet assembly 400 having a first engagement stringer 402*a*, a second engagement stringer 402*b* (not shown), a first stringer 410*a*, a second stringer 410*b* (not shown), a third stringer 410*c* (not shown), a first top slat 421*a*, a second top slat 421*b* (not shown), a third top slat 421*c* (not shown), a fourth top slat 421*d* (not shown), a fifth top slat 421*e* (not shown), and mechanical fasteners 430, 440. As illustrated, the first engagement stringer 402*a* serves to receive and hold the mechanical fasteners 440*a*, 440*b* for securably attaching the first stringer 410*a* to the engagement stringer 402*a*. Each of the first target 402*a*, the first stringer 410*a*, and the first top slat 421*a* include an embedded multilayer composite strip 419 in order to provide increased strength and stiffness. The first stringer 410*a* is processed to include surface features 416 or slots (best seen in FIG. 4A) to allow the first top slat 421*a* to mate with and be held by the frame 401. In particular, in FIG. 3, the first top slat 421*a* has two legs 422 that are complementary to the slots 416 defined by the first stringer 410*a*, and are fit into each corresponding slot 416. Mechanical fasteners 430*a*, 430*b* are driven through the first top slat 421*a* and into the first stringer 410*a* (into the internal screw boss 418*a*'; not shown) to provide additional engagement support between the first top slat 421*a* and the first stringer 410*a*.

Moreover, and with further specificity, the first end 411*a* of the first stringer 410*a* is to be engaged to the first engagement stringer 402*a* via the mechanical fasteners 440*a*, 440*b* to form a corner of a frame 401. As shown in FIG. 3, the first engagement stringer 402*a* has internal screw bosses 418*a*, 418*b* to receive a portion of the mechanical fasteners 440*a*, 440*b*. Importantly, similar to the illustration of FIG. 1B, individual mechanical fasteners 440*a*, 440*b* are driven through the screw bosses 418*a*, 418*b*, respectively, of the first engagement stringer 402*a* into the screw bosses 418*a*', 418*b*' (not shown), respectively, of the first stringer 410*a*. In particular, in FIG. 3, the individual mechanical fasteners 440*a*, 440*b* are driven through two pre-drilled holes 417 defined by the first engagement stringer 402*a* and through the internal screw bosses 418*a*, 418*b*, through the embedded multilayer composite strip 319 of the first target 402*a*, and continue into the internal screw bosses 418*a*', 418*b*' of the first stringer 410*a*.

Figure 4A:
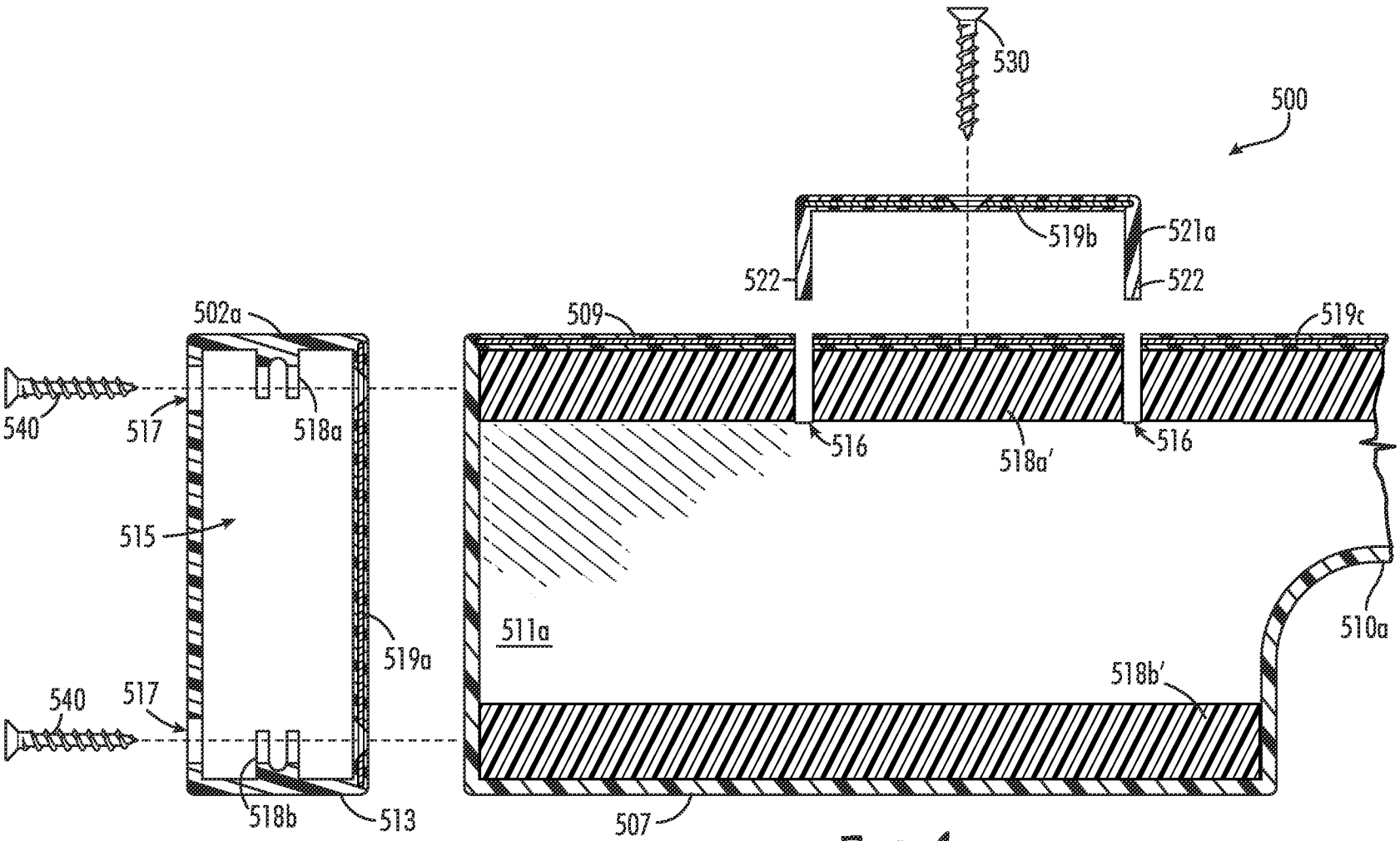
FIG. 4A is a cross-sectional view of a partial, exploded illustration of an example corner of an example frame of an example pallet assembly according to the present disclosure.

Referring now to FIG. 4A, a cross-sectional view of a partial exploded illustration of an example corner of an example frame of an example pallet assembly according to the present disclosure is shown. In particular, in FIG. 4A, there is shown a pallet assembly 500 having a first engagement stringer 502*a*, a second engagement stringer 502*b* (not shown), a first stringer 510*a*, a second stringer 510*b* (not shown), a third stringer 510*c* (not shown), a first top slat 521*a*, a second top slat 521*b* (not shown), a third top slat 521*c* (not shown), a fourth top slat 521*d* (not shown), a fifth top slat 521*e* (not shown), and mechanical fasteners 530, 540. As illustrated, the first engagement stringer 502*a* serves to receive and hold the mechanical fasteners 540*a*, 540*b* for securably attaching the first stringer 510*a*. Each of the first target 502*a*, the first stringer 510*a*, and the first top slat 521*a* include an embedded multilayer composite strip 519 in order to provide increased strength and stiffness. The first stringer 510*a* is processed to include a first cut-out target 514*a* (shown) and a second target 514*b* (not shown). The first stringer 510*a* also is processed to include a plurality of slots 516 that allows the plurality of top slats 521 to mate with and be held by the frame 501.

In particular, in FIG. 4A, the first engagement stringer 502*a* has profile including an internal space 515 and a profile wall 513 at least partially defining the internal space 515. Moreover, the first stringer 510*a* has a first end 511*a*, a second end 512*a* (not shown), a top wall 509, a bottom wall 507, and internal screw bosses 518*a*', 518*b*'. Moreover, as illustrated, the first top slat 521*a* has two legs 522 that are complementary to the slots 516 defined by the top wall 509 of the first stringer 510*a*. Mechanical fastener 530*a* may be driven through the first top slat 521*a*, through the embedded multilayer composite strip 519*b* and through the embedded multilayer composite strip 519*c* into the internal screw boss 518*a*' to provide additional engagement support between the first top slat 521*a* and the first stringer 510*a*.

Moreover, and with further specificity, the first end 511*a* of the first stringer 510*a* is to be engaged to the first engagement stringer 502*a* via the mechanical fasteners 540 to form a corner of a frame 501. As shown in FIG. 4A, the first engagement stringer 502*a* has internal screw bosses 518*a*, 518*b* to receive a portion of the mechanical fasteners 540*a*, 540*b*. Importantly, similar to the illustration of FIGS. 1B and 3, individual mechanical fasteners 540*a*, 540*b* are driven through the screw bosses 518*a*, 518*b*, respectively, of the first engagement stringer 502*a* into the screw bosses 518*a*', 518*b*', respectively, of the first stringer 510*a*. In particular, in FIG. 4A, the individual mechanical fasteners 540 are driven through two pre-drilled holes 517 defined by the first engagement stringer 502*a* and through the internal screw bosses 518*a*, 518*b*, through the embedded multilayer composite strip 519*a* of the first target 502*a*, and continue into the internal screw bosses 518*a*', 518*b*' of the first stringer 510*a*.

Furthermore, with further specificity, the first end 511*a* of the first stringer 510*a* is processed to include a first cut-out target 514*a* (shown) and a second target 514*b* (not shown). The bottom wall 507 of the first stringer 510*a* may be cut and processed to expose an opening to the internal space 515 and to remove a portion of the internal screw boss 518*b*'.

Figure 4B:
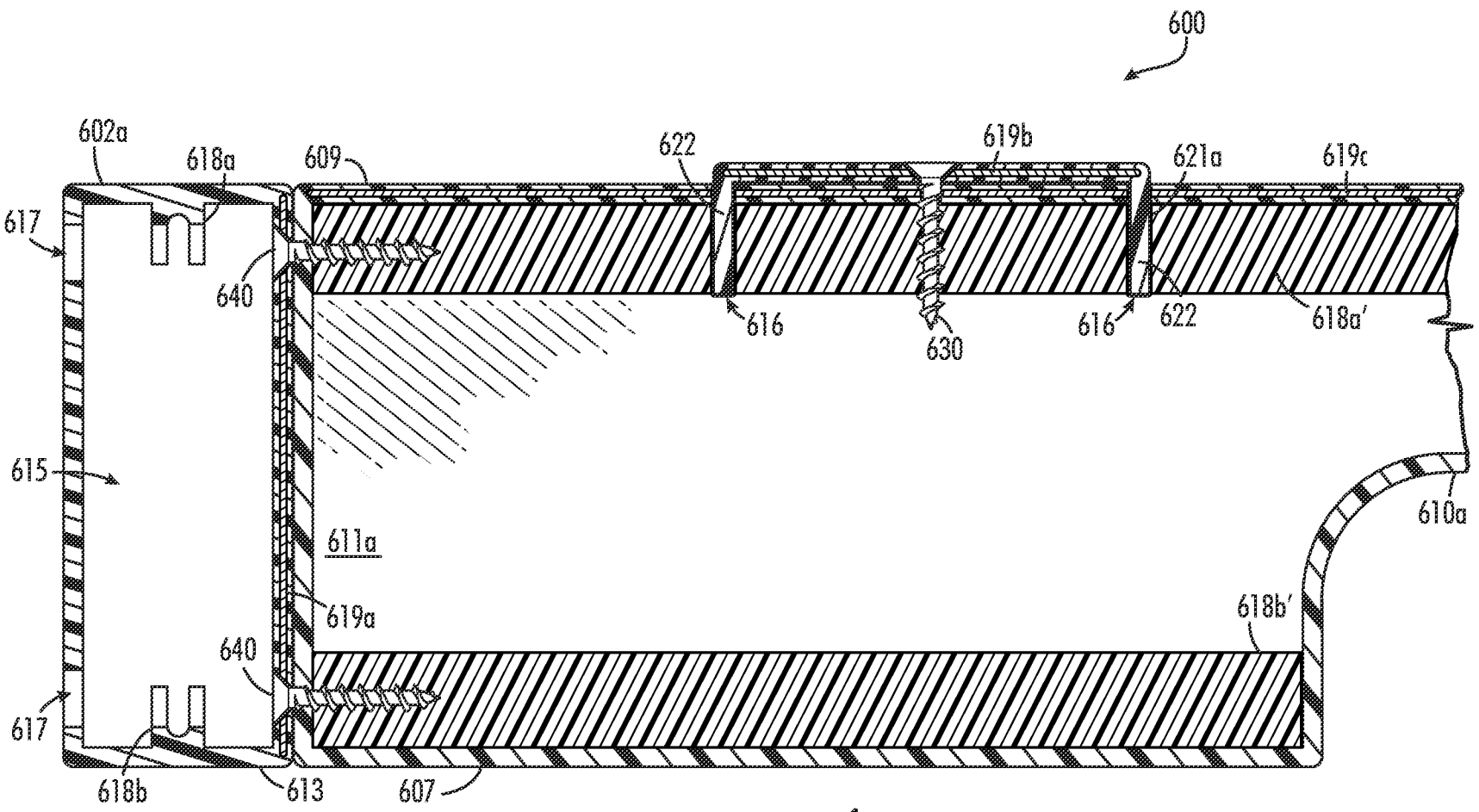
FIG. 4B is a cross-sectional view of a partial illustration of an example corner of an example frame of an example pallet assembly according to the present disclosure.

Referring now to FIG. 4B, a cross-sectional view of a partial illustration of an example corner of an example frame of an example pallet assembly according to the present disclosure is shown. In particular, in FIG. 4B, there is shown a pallet assembly 600 having a first engagement stringer 602*a*, a second engagement stringer 602*b* (not shown), a first stringer 610*a*, a second stringer 610*b* (not shown), a third stringer 610*c* (not shown), a first top slat 621*a*, a second top slat 621*b* (not shown), a third top slat 621*c* (not shown), a fourth top slat 621*d* (not shown), a fifth top slat 621*e* (not shown), and mechanical fasteners 630, 640. As illustrated, the first engagement stringer 602*a* receives and holds the mechanical fasteners 640*a*, 640*b* to securably attach the first stringer 610*a*. Each of the first target 602*a*, the first stringer 610*a*, and the first top slat 521*a* include an embedded multilayer composite strip 619. The first stringer 610*a* also is processed to include surface features 616 and a first cut-out target 614*a* (shown) and a second target 614*b* (not shown).

In particular, in FIG. 4B, the first engagement stringer 602*a* has profile including an internal space 615 and a profile wall 613 at least partially defining the internal space 615. Moreover, the first stringer 610*a* has a first end 611*a*, a second end 612*a* (not shown), a top wall 609, a bottom wall 607, and internal screw bosses 618*a*', 618*b*'. Moreover, as illustrated, the first top slat 621*a* has a main wall 605 and two legs 622 that are complementary to the slots 616 defined by the top wall 609 of the first stringer 610*a*. Mechanical fasteners 630*a* are driven through the first top slat 621*a*, through the embedded multilayer composite strip 619*b* and through the embedded multilayer composite strip 619*c* and into the internal screw boss 618*a*' to provide additional engagement support between the first top slat 621*a* and the first stringer 610*a*.

Moreover, and with further specificity, the first end 611*a* of the first stringer 610*a* is engaged to the first engagement stringer 602*a* via the mechanical fasteners 640*a*, 640*b* to form a corner of a frame 601. As shown in FIG. 4B, the first engagement stringer 602*a* has internal screw bosses 618*a*, 618*b* to receive a portion of the mechanical fasteners 640*a*, 640*b*. Importantly, individual mechanical fasteners 640*a*, 640*b* are driven through the screw bosses 618*a*, 618*b*, respectively, of the first engagement stringer 602*a* into the screw bosses 618*a*', 618*b*' of the first stringer 610*a*. In particular, in FIG. 4B, the individual mechanical fasteners 640 are driven through two pre-drilled holes 617 defined by the first engagement stringer 602*a* and through the internal screw bosses 618*a*, 618*b*, through the embedded multilayer composite strip 619*a* of the first target 602*a*, and into the internal screw bosses 618*a*', 618*b*' of the first stringer 610*a*.

IV. EMBODIMENTS

Certain implementations of systems and methods consistent with the present disclosure are provided as follows:

Implementation 1: A pallet assembly, comprising:

(i) a lineal engagement stringer having a profile and an embedded lineal reinforcement, the profile comprising an internal space and a profile wall at least partially defining the internal space;

(ii) a lineal stringer having a first end, a second end, a top wall, an internal screw boss, and an embedded lineal reinforcement, the top wall of the lineal stringer defining a plurality of slots;

(iii) a lineal slat having a main wall, a leg, and an embedded lineal reinforcement, a portion of the leg configured to friction fit into a slot of the plurality of slots of the lineal stringer, a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

Implementation 2: The pallet assembly of the preceding implementation, wherein each slot of the plurality of slots of the lineal stringer corresponds to an individual lineal slat.

Implementation 3: The pallet assembly of any of the preceding implementations, wherein each pair of slots of the plurality of slots of the lineal stringer corresponds to an individual lineal slat.

Implementation 4: The pallet assembly of any of the preceding implementations, further comprising a second lineal engagement stringer and a second mechanical fastener for securably fastening the second end of the lineal stringer to the second lineal engagement stringer.

Implementation 5: The pallet assembly of any of the preceding implementations, further comprising a second lineal stringer and a third lineal stringer;

wherein a second portion of the leg of the lineal slat is configured to friction fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to friction fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Implementation 6: The pallet assembly any of the preceding implementations, further comprising:

a second lineal engagement stringer;

a second lineal stringer and a third lineal stringer;

a second mechanical fastener for securably fastening the second end of the lineal stringer to the second lineal engagement stringer;

a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to friction fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to friction fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Implementation 7: The pallet assembly of any the preceding implementation, wherein the lineal engagement stringer and the second lineal engagement stringer sandwich the lineal stringer, the second lineal stringer, and the third lineal stringer.

Implementation 8: The pallet assembly of the preceding implementations, further comprising a plurality of mechanical fasteners for traversing the main wall of the lineal slat and engaging with the internal screw boss of the lineal stringer, to securably fasten the lineal slat to the lineal stringer.

Implementation 9: The pallet assembly any of the preceding implementations, wherein the profile of the lineal engagement stringer further comprises a multilayer composite strip orientated parallel to the profile wall.

Implementation 10: The pallet assembly any of the preceding implementations, wherein the lineal stringer further comprises a multilayer composite strip orientated parallel to the top wall.

Implementation 11: The pallet assembly any of the preceding implementations, wherein the lineal slat further comprises a multilayer composite strip orientated parallel to the main wall.

Implementation 12: A pallet assembly, comprising:

(i) a lineal engagement stringer having a profile, the profile comprising an internal space, a profile wall at least partially defining the internal space, and a multilayer composite strip orientated parallel to the profile wall;

(ii) a lineal stringer having a first end, a second end, a top wall, an internal screw boss, and a multilayer composite strip orientated parallel to the top wall, the top wall of the lineal stringer defining a plurality of slots;

(iii) a lineal slat having a main wall, a multilayer composite strip orientated parallel to the main wall and a leg, a portion of the leg configured to friction fit into a slot of the plurality of slots of the lineal stringer, and a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

Implementation 13: The pallet assembly of the preceding implementation, wherein each slot of the plurality of slots of the lineal stringer avoids the multilayer composite strip of the lineal stringer.

Implementation 14: The pallet assembly any of the preceding implementations, further comprising a second lineal engagement stringer and a second mechanical fastener for securably fastening the second end of the lineal stringer to the second lineal engagement stringer.

Implementation 15: The pallet assembly any of the preceding implementations, further comprising a second lineal stringer and a third lineal stringer;

wherein a second portion of the leg of the lineal slat is configured to friction fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to friction fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Implementation 16: The pallet assembly of the preceding implementation, further comprising:

a second lineal engagement stringer;

a second lineal stringer and a third lineal stringer;

a second mechanical fastener for securably fastening the second end of the lineal stringer to the second lineal engagement stringer;

a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to friction fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to friction fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

Implementation 17: The pallet assembly of the preceding implementation, wherein the lineal engagement stringer and the second lineal engagement stringer sandwich the lineal stringer, the second lineal stringer, and the third lineal stringer.

Implementation 18: The pallet assembly of any of the preceding implementations, further comprising a plurality of mechanical fasteners for traversing the main wall of the lineal slat and engaging with the internal screw boss of the lineal stringer, to securably fasten the lineal slat to the lineal stringer.

Implementation 19: A method of assembling a pallet assembly, the method comprising:

(a) providing a lineal engagement stringer having a profile and an embedded lineal reinforcement, the profile comprising an internal space and a profile wall at least partially defining the internal space;

(ii) providing a lineal stringer having a first end, a second end, a top wall, an internal screw boss, and an embedded lineal reinforcement, the top wall of the lineal stringer defining a plurality of slots;

(iii) providing a lineal slat having a main wall, a leg, and an embedded lineal reinforcement, a portion of the leg configured to friction fit into a slot of the plurality of slots of the lineal stringer, a portion of the main wall configured to sit on a portion of the top wall when the leg is pressed into the slot of the lineal stringer; and (iv) providing a screw for traversing the profile wall of the lineal engagement stringer and engaging with the internal screw boss of the lineal stringer, to securably fasten the first end of the lineal stringer to the lineal engagement stringer.

Implementation 20: The method of the preceding implementation, further comprising assembling the pallet by securably fastening the first end of the lineal stringer to the lineal engagement stringer and pressing the leg of the lineal slat into the slot of the lineal stringer such that the portion of the main wall of the lineal slat sits on the portion of the top wall of the lineal stringer.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A structurally reinforced pallet assembly, comprising:

(i) a lineal engagement stringer having a profile and an embedded lineal reinforcement, the profile comprising an internal space and a profile wall at least partially defining the internal space;

(ii) a lineal stringer having a first end, a second end, a top wall, an internal screw boss, and an embedded lineal reinforcement, the top wall of the lineal stringer defining a plurality of slots;

(iii) a lineal slat having a main wall, a leg, and an embedded lineal reinforcement, a portion of the leg configured to fit into a slot of the plurality of slots of the lineal stringer, a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

2. The pallet assembly of claim 1, wherein each slot of the plurality of slots of the lineal stringer corresponds to an individual lineal slat.

3. The pallet assembly of claim 1, wherein each pair of slots of the plurality of slots of the lineal stringer corresponds to an individual lineal slat.

4. The pallet assembly of claim 1, further comprising a second lineal engagement stringer and a second mechanical fastener for securably fastening the second end of the lineal stringer to the second lineal engagement stringer.

5. The pallet assembly of claim 1, further comprising a second lineal stringer and a third lineal stringer;

wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

6. The pallet assembly of claim 1, further comprising:

a second lineal engagement stringer;

a second lineal stringer and a third lineal stringer;

a second mechanical fastener for securably fastening the second end of the lineal stringer to the second lineal engagement stringer;

a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

7. The pallet assembly of claim 6, wherein the lineal engagement stringer and the second lineal engagement stringer sandwich the lineal stringer, the second lineal stringer, and the third lineal stringer.

8. The pallet assembly of claim 6, further comprising a plurality of mechanical fasteners for traversing the main wall of the lineal slat and engaging with the internal screw boss of the lineal stringer, to securably fasten the lineal slat to the lineal stringer.

9. The pallet assembly of claim 6, wherein the profile of the lineal engagement stringer further comprises a multilayer composite strip orientated parallel to the profile wall as the embedded lineal reinforcement.

10. The pallet assembly of claim 6, wherein the lineal stringer further comprises a multilayer composite strip orientated parallel to the top wall as the embedded lineal reinforcement.

11. The pallet assembly of claim 10, wherein the lineal slat further comprises a multilayer composite strip orientated parallel to the main wall as the embedded lineal reinforcement.

12. A structurally reinforced pallet assembly, comprising:

(i) a lineal engagement stringer having a profile, the profile comprising an internal space, a profile wall at least partially defining the internal space, and a multilayer composite strip orientated parallel to the profile wall;

(ii) a lineal stringer having a first end, a second end, a top wall, an internal screw boss, and a multilayer composite strip orientated parallel to the top wall, the top wall of the lineal stringer defining a plurality of slots;

(iii) a lineal slat having a main wall, a multilayer composite strip orientated parallel to the main wall and a leg, a portion of the leg configured to fit into a slot of the plurality of slots of the lineal stringer, and a portion of the main wall configured to sit on a portion of the top wall when the leg is pressed into the slot of the lineal stringer; and (iv) a mechanical fastener for traversing the profile wall of the lineal engagement stringer and engaging with the internal screw boss of the lineal stringer, to securably fasten the first end of the lineal stringer to the lineal engagement stringer.

13. The pallet assembly of claim 12, wherein each slot of the plurality of slots of the lineal stringer avoids the multilayer composite strip of the lineal stringer.

14. The pallet assembly of claim 12, further comprising a second lineal engagement stringer and a second mechanical fastener for securably fastening the second end of the lineal stringer to the second lineal engagement stringer.

15. The pallet assembly of claim 12, further comprising a second lineal stringer and a third lineal stringer;

wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer; and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

16. The pallet assembly of claim 12, further comprising:

a second lineal engagement stringer;

a second lineal stringer and a third lineal stringer;

a second mechanical fastener for securably fastening the second end of the lineal stringer to the second lineal engagement stringer;

a third mechanical fastener for securably fastening the second end of the second lineal stringer to the second lineal engagement stringer; and a third mechanical fastener for securably fastening the second end of the third lineal stringer to the second lineal engagement stringer, wherein a second portion of the leg of the lineal slat is configured to fit into a slot of a plurality of slots of the second lineal stringer, a second portion of the main wall of the lineal slat configured to sit on a second portion of the top wall of the second lineal stringer when the leg is pressed into the slot of the lineal stringer and the leg is pressed into the slot of the second lineal stringer, and wherein a third portion of the leg of the lineal slat is configured to fit into a slot of a plurality of slots of the third lineal stringer, a third portion of the main wall configured to sit on a third portion of the top wall of the third lineal stringer when the leg is pressed into the slot of the lineal stringer and the leg is pressed into the slot of the second lineal stringer and the leg is pressed into the slot of the third lineal stringer.

17. The pallet assembly of claim 16, wherein the lineal engagement stringer and the second lineal engagement stringer sandwich the lineal stringer, the second lineal stringer, and the third lineal stringer.

18. The pallet assembly of claim 16, further comprising a plurality of mechanical fasteners for traversing the main wall of the lineal slat and engaging with the internal screw boss of the lineal stringer, to securably fasten the lineal slat to the lineal stringer.

19. A method of assembling a structurally reinforced pallet assembly, the method comprising:

(i) providing a lineal engagement stringer having a profile and an embedded lineal reinforcement, the profile comprising an internal space and a profile wall at least partially defining the internal space;

(ii) providing a lineal stringer having a first end, a second end, a top wall, an internal screw boss, a target insert, and an embedded lineal reinforcement, the top wall of the lineal stringer defining a plurality of slots;

(iii) providing a lineal slat having a main wall, a leg, and an embedded lineal reinforcement, a portion of the leg configured to fit into a slot of the plurality of slots of the lineal stringer, a portion of the main wall configured to sit on a portion of the top wall when the leg is pressed into the slot of the lineal stringer; and (iv) providing a screw for traversing the profile wall of the lineal engagement stringer and engaging with the internal screw boss of the lineal stringer, to securably fasten the first end of the lineal stringer to the lineal engagement stringer.

20. The method of claim 19, further comprising assembling the pallet by securably fastening the first end of the lineal stringer to the lineal engagement stringer and pressing the leg of the lineal slat into the slot of the lineal stringer such that the portion of the main wall of the lineal slat sits on the portion of the top wall of the lineal stringer.

* * * * *